US007330121B2

(12) United States Patent
Schoppmeyer

(10) Patent No.: US 7,330,121 B2
(45) Date of Patent: Feb. 12, 2008

(54) METHOD FOR LOCATING A LOST REGISTERED PERSON

(76) Inventor: Martin Schoppmeyer, 2950 Sheryl Ave., Fayetteville, AR (US) 72703-3542

( * ) Notice: Subject to any disclaimer, the term of this patent is extended or adjusted under 35 U.S.C. 154(b) by 88 days.

(21) Appl. No.: 11/084,907

(22) Filed: Mar. 21, 2005

(65) Prior Publication Data

US 2006/0208909 A1 Sep. 21, 2006

(51) Int. Cl.
*G08B 23/00* (2006.01)

(52) U.S. Cl. ..... 340/573.1; 340/573.4; 340/573.5; 340/573.7

(58) Field of Classification Search ..... 340/573.1, 340/573.3, 573.4, 572.1, 572.2, 539.11, 539.13, 340/539.15, 573.5, 573.7, 539.1, 505, 506; 707/7, 10, 200
See application file for complete search history.

(56) References Cited

U.S. PATENT DOCUMENTS 6,401,095 B1 * 6/2002 Adler ..... 707/10
6,505,203 B1 * 1/2003 Adler ..... 707/10
6,581,073 B1 * 6/2003 Adler ..... 707/200
6,747,562 B2 * 6/2004 Giraldin et al. ..... 340/573.1
7,030,765 B2 * 4/2006 Giraldin et al. ..... 340/573.1

* cited by examiner

*Primary Examiner*—Van T. Trieu
(74) *Attorney, Agent, or Firm*—Mueller Smith & Matto

(57) ABSTRACT

The present invention is addressed to a method for establishing a membership of subscribing members for alerting each to the loss of a registered person within a subscribing member. The method commences by establishing a membership of one or more subscribing members. The next step is to provide each subscribing member with access to a registration station capable of receiving registration information for a person to be registered and issuing a registered person indicator, and an alert station where a custodian of the registered person can enter the registered person indicator for issuing an alert that the registered person is lost. Finally, the method includes the step of creating a database interconnected to each of the subscribing member's registration station and alert station via a computer network.

13 Claims, 2 Drawing Sheets

METHOD FOR LOCATING A LOST REGISTERED PERSON

CROSS-REFERENCE TO RELATED APPLICATIONS

Not applicable

STATEMENT REGARDING FEDERALLY SPONSORED RESEARCH

Not applicable.

BACKGROUND OF THE INVENTION

Quickly locating lost individuals is an on-going and increasingly complex problem. Statistics indicate that more people in the United States are living in metropolitan areas. In 1900, the Census Bureau reported that 3 cities had populations greater than one million. Between 1900 and 1950, that number rose to 5. The 2000 Census indicated, however, that the number of cities with a population over one million rose to a staggering 50. The concentration of people in given areas results in corresponding increases in the size of schools, neighborhoods, and retail establishments. These areas of higher population also have increased traffic and increased crime. Under these circumstances there is a greater risk of injury to a lost child. The likelihood of abduction also increases. In recent years, there has been a significant increase in the number of kidnappings of children by a non-custodial parent.

Clearly, the category of persons at greatest risk is young children. Also at risk are impaired adults who require the attention of a custodian. Such impaired adults may be, for example, those who are mentally handicapped or who suffer from a disease, such as Alzheimer's, or a mental illness, such as schizophrenia. When a child or impaired adult becomes lost, i.e., the person's location is unknown to his or her custodian, it is imperative that the lost individual be located as quickly as possible.

Several systems for recovering lost individuals are known to the art. For example, U.S. Pat. No. 4,650,219 describes a system that assists in notifying a parent when a child becomes lost. The system utilizes a marker that is carried by the child. The system assigns an identification number to the child. That identification number, along with the phone number for a central station, is provided on an ID marker carried on the child's clothing. When a lost child is found, authorities can call the number and report the child's recovery to the central station. The central station uses the identification number to identify the child and to notify the child's parents. Utilizing this system, a child can be identified without disclosing the child's identity to the person who has located the child.

PCT Published Application No. WO 92/09080 describes an information-conveying device that can be worn by people or pets. The device records an audio message which conveys information about the person or pet. The person or pet wears the device on a belt, collar, or bracelet. If the person or pet becomes lost or injured, for example, the message can be replayed to convey vital identification or treatment information.

U.S. Pat. No. 5,765,875 discloses an identification system for use with children traveling as a group. The system includes an identification tag for each child, including the child's identification number and the group's identification number. The system also includes an information sheet for each child, including the child's identification number and biographical information about the child. A notebook is provided for storing the information sheets and the identification tags. Individual pockets are provided for each ID tag and information sheet. When traveling, the children's custodian distributes the ID tags to the children and carries the notebook containing the corresponding information sheets.

PCT Published Application No. WO 98/28908 describes a device or kiosk for capturing data to create an Avatar, or 3-dimensional shape, of a person. The device also measures the weight and captures the voice of the person. The device may be used, for example, to create an animation of the person based on the Avatar.

U.S. Pat. No. 5,878,116 describes a telephone system for locating lost items. The system includes a card retained by the item owner and a tag attached to the item itself. When the item becomes lost, the owner calls a telephone number and opens a voice mailbox associated with the item's identification number. When the item is discovered, the locator calls the number provided on the item's tag and accesses the voice mailbox associated with the identification number, also provided on the tag, to leave a message for the owner that the lost item has been recovered.

JP 2000123090A2 (Abstract of Publication) describes a radio-based system for locating lost children. The system consists of a card which is read into the system and the information concerning the child is projected on the terminals at each sales counter.

U.S. Pat. No. 6,505,203 B1 describes an email system for notifying individuals in a given geographic area when an individual becomes lost. When an individual is determined to be missing, the parent or guardian calls or electronically notifies the system and provides pertinent data about the missing individual. The system then determines a relevant geographic area and sends email notices to public and private institutions and individuals within that geographic area. The entities notified are selected from a pre-established database.

Although there are systems available to assist in the recovery of lost persons, improvements continue to be sought. In particular, a system is needed that facilitates the registration of at risk individuals and is better able to alert officials and by-standers in a given area to the existence of a lost individual.

BRIEF SUMMARY OF THE INVENTION

The present invention is addressed to a method for establishing a membership of subscribing members for alerting each to the loss of a registered person within a subscribing member. The method commences by establishing a membership of one or more subscribing members. Then, each subscribing member is provided with access to a registration station having an input for receiving registration information for a person to be registered and an output for issuing a registered person indicator, and an alert station whereat a custodian of the registered person enters the registered person indicator for issuing an alert that the registered person is lost. Finally, a database is created which interconnects each subscribing member's registration station and alert station via a computer network. Preferably, the computer network is the Internet.

Once a membership of subscribing members has been established, a custodian enters registration information at the input of any of the subscribing member's registration station. The registration station issues the registered person indicator to the custodian at the registration station's output station. The registration information is within the database and is accessible by any of the subscribing members. When the registered person is determined to be missing, the registered person indicator is submitted to any of the subscribing member's alert station and an alert is issued to notify individuals to the loss of a registered person within the subscribing member.

BRIEF DESCRIPTION OF THE DRAWINGS

For a fuller understanding of the nature and advantages of the present invention, reference should be had to the following detailed description taken in connection with the accompanying drawings, in which.

DETAILED DESCRIPTION OF THE INVENTION

The present invention is addressed to a method for establishing a membership of subscribing members and alerting each to the existence of a lost person within one of the subscribing members. Once the membership has been established, a database is created, which interconnects the subscribing members via a computer network and maintains information on registered individuals. When an individual becomes lost, the person's custodian communicates that fact to the member and an alert is issued.

Figure 1:
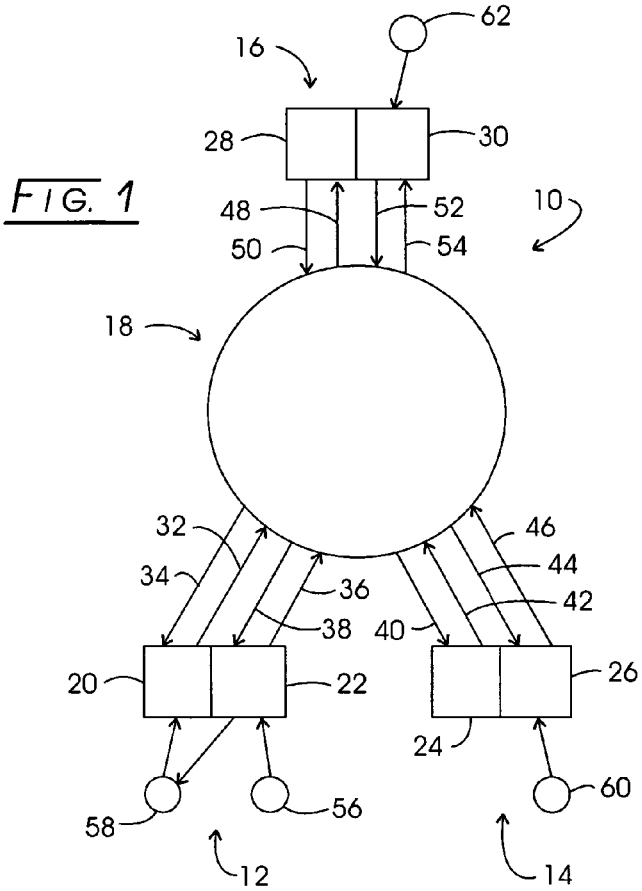
FIG. 1 is a pictorial representation of a membership of three subscribing members and the interconnection thereof.

FIG. 1 illustrates an example membership consisting of three members. This number of members is for ease of description as the number of subscribing members may be one or more, even thousands. The membership is represented generally at 10 and consists of three subscribing members, 12, 14, and 16. The subscribing members may be stores, neighborhoods, schools, or any other location where an individual may become lost. For example, subscribing members 12, 14, and 16 may be three retail stores of a chain, such as WALMART, MACY's, TARGET, etc.

Each subscribing member has access to a registration station and an alert station. Each registration station has an input for receiving registration information for the person to be registered and an output for issuing a registered person indicator. At any of the alert stations within the membership, a custodian can enter a registered person indicator in order to alert persons within a subscribing member that the registered person is missing. The registration station, alert station, and registered person indicator are described in greater detail later in connection with FIGS. 2, 3A, and 3B. As seen in FIG. 1, subscribing member 12 has access to registration station 20 and alert station 22. Subscribing member 14 has access to registration station 24 and alert station 26, while subscribing member 16 has access to registration station 28 and alert station 30. Although each subscribing member in this example has its own registration station and alert station, multiple subscribing members may share access to a registration station or alert station. Conversely, more registration and alert stations may be provided, but, each subscribing member must have at least one registration station and one alert station.

After the membership of subscribing members has been established, a database is created that interconnects each subscribing member's registration station and alert station via a computer network. The computer network may be, for example, the global computer network commonly referred to as the Internet. Alternatively, the computer network may be an independent computer network supported by a private entity. In FIG. 1, the registration stations and alert stations of subscribing members 12, 14, and 16 are seen to be connected to a database shown generally at 18. Information can be conveyed from registration station 20 to database 18 as indicated by directional arrow 32. Likewise, information can be conveyed from database 18 to registration station 20 as indicated by arrow 34. In similar fashion, information is communicated between alert station 22 and database 18 as indicated by arrows 36 and 38. Looking to subscribing member 14, information is conveyed between registration station 24 as shown by directional arrows 40 and 42. Information is conveyed between alert station 26 and database 18 as shown by arrows 44 and 46. Finally, arrows 48 and 50 illustrate communication between registration station 28 and database 18, while arrows 52 and 54 illustrate communication between alert station 30 and database 18.

Database 18 may be maintained at a central location, the database being accessed by the subscribing members as described above. Alternatively, a copy of the database may be maintained at one or more of the subscribing members. These copies then may be automatically, remotely updated when new information is entered at any of the subscribing members' registration stations.

With the membership established and the database created, a custodian can go to any one of the registration stations, such as 20, 24 or 28 to register an individual. Any individual may be registered, but the system is particularly advantageous for locating children and impaired adults. In the example shown in FIG. 1, a custodian, 58, goes to registration station 20 to enter registration information for an individual, i.e., John Doe. Each registration station, as noted above, has an input for obtaining information and an output for issuing a registered person indicator. The registration stations may be provided in any convenient manner to perform these functions.

Figure 2:
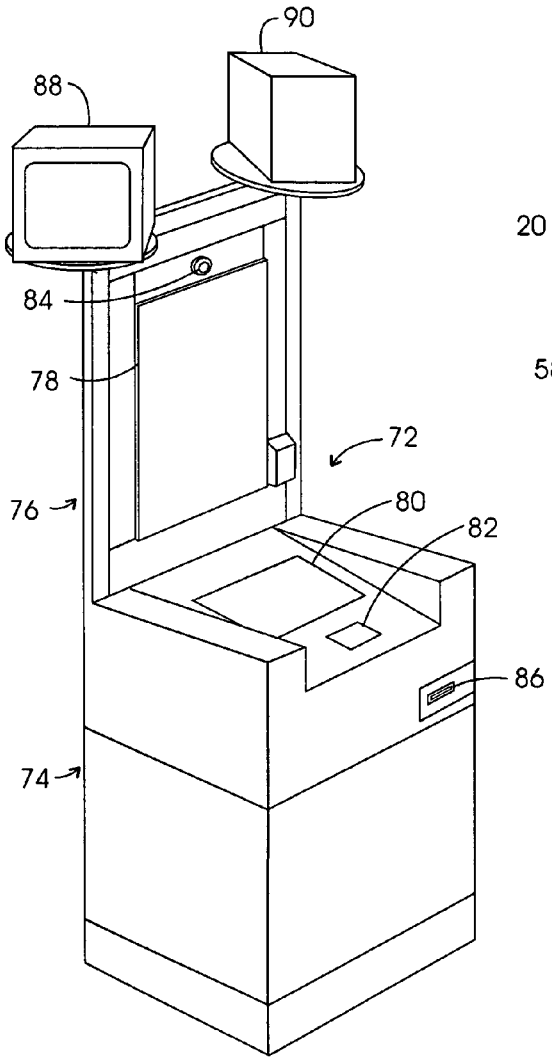
FIG. 2 is a perspective view of a registration station for registering an individual.

Looking to FIG. 2, a registration station, in the form of a kiosk, is shown. The kiosk is represented generally at 72 including a base, 74, and an upstanding portion, 76. The input of kiosk 72 includes a keyboard 80 and a roller ball or mouse, 82. Upstanding portion 76 also includes a recessed, flat panel monitor 78. Using these components, custodian 58 enters the registration information for his or her charge. Upstanding portion 76 also includes a digital camera, 84, so that a photograph of the registered person may be included as part of the registration information. Information entered at kiosk 72 is transmitted via the computer network to database 18 via line 32. The computer network assigns an account number or other identifier to that registration information. Once the information has been entered and an identifier assigned, the output of the registration station issues a registered person indicator to the custodian. The registered person indicator may be an identification card, similar to a credit card, which has a magnetic strip and bears the registered person's name and the identifier. Other indicators, such as a simple code (e.g., alphanumeric), fingerprint ID, retinal scans, voice patterns, and the like, may be utilized.

Figure 3A:
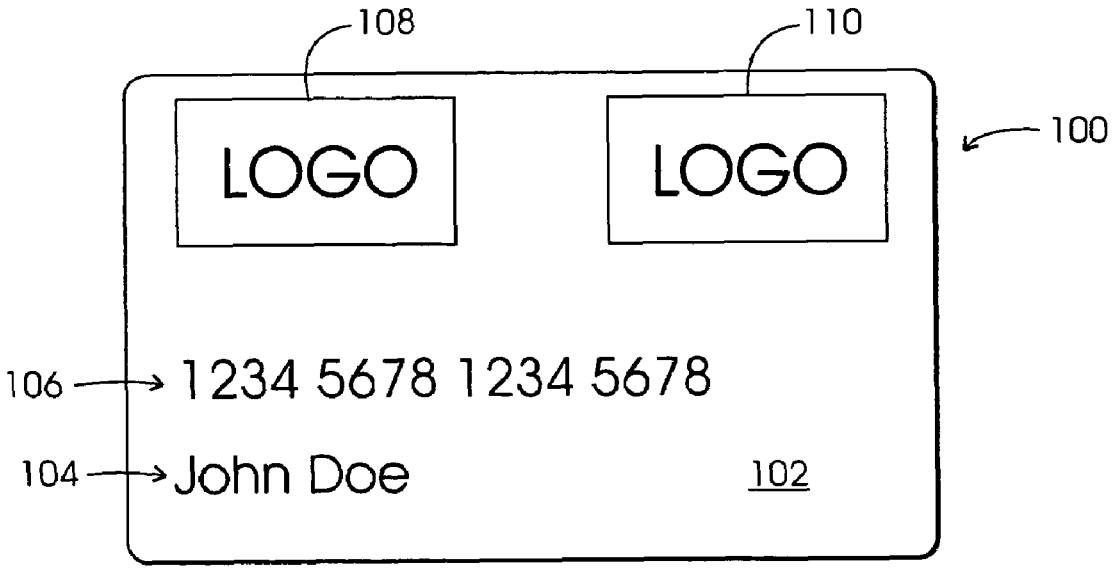
FIG. 3A is a front view of an identification card for a registered individual.
Figure 3B:
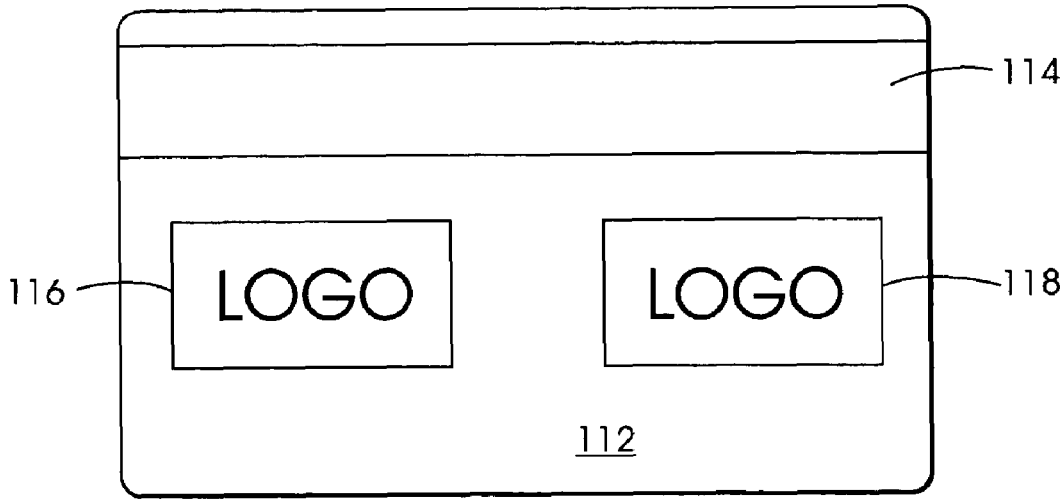
FIG. 3B is a back view of the identification card showing a magnetic strip and two logos.

FIGS. 3A and 3B show a sample identification card. The card, illustrated generally at 100 has a front surface, 102, which bears the registered person's name, John Doe, at 104.

Also on front surface 102 is an identifier, 106, in the form of a sixteen digit account number. Card 100 also may bear other alphanumeric characters or graphics. For example, card 100 includes graphics in the form of logos, 108 and 110. These graphics may be advertising logos. Alternatively, the registration station may include a printer that allows custodian 58 to personalize card 100 by adding selected graphics at 108 and 110. FIG. 3B shows the back surface, 112, of card 100. Back surface 112 includes a magnetic strip. 114, and additional logos, 116 and 118. The content of these spaces, like those on front surface 102, may be determined by the card issuer or may be personalized by the custodian.

Returning to FIG. 2, the output of kiosk 72 is seen to be the input/output slot, 86, of a magnetic card reader contained within kiosk 72. Custodian 58 receives card 100 from slot 86. Once kiosk 72 issues card 100, custodian 58 can test the card by inserting it back into the slot (not shown) of a second magnetic card reader. The computer network then accesses the registered person information associated with card 100 and displays select information to custodian 58. The select information may be displayed at monitor 78. Monitors, such as those shown at 88 and 90, also may be provided to display the select information. When a registered person's information is not being displayed, monitors 88 and 90 may be used to display other information. Such information may include advertising information or public interest information. A custodian can update the registered person's information at any time and at any subscribing member's registration station.

Alternatively, the custodian may update the registered person's information by accessing database 18 via the Internet. A web address may be provided to the custodian, for example, during the registration process. For security purposes, a user name and password also may be provided at that time. Thereafter, the custodian can access the website and enter his or her username, password and the registered person's identifier. That identifier may be, for example, the previously described 16 digit account number. The custodian then can view, modify, and update the registered person's information.

Identification card 100 is easily portable and can be carried in a purse, wallet, or pocket. If the registered individual's custodian should change, i.e., the child may be with a different parent, a sibling, a babysitter, etc., then the identification card can be transferred to the registered person's current custodian. If custodian 58's registered person were to become lost, then custodian 58 could use the alert station of any subscribing member to issue an alert notifying people within that subscribing member of the existence of the lost person. For example, if the registered person were to become lost in subscribing member 14, custodian 58 could go to alert station 26. Alert station 26 may be a kiosk similar to that shown in FIG. 2. To issue an alert, custodian 58 inserts card 100 into a card reader at the alert station. The computer network accesses database 18, as indicated at arrow 46, to retrieve the registered person information associated with the registered person indicator. The accessed information is transmitted to alert station 26 via arrow 44. Alert station 26 then issues an alert. The alert may be made in the form of a visual or audio display. The registered person's photograph and relevant data may be displayed along with instructions on what to do when the registered person is located. The alert may be issued to all persons in a given area or, alternatively, may be issued to select persons, such as store security.

Instead of stores in a chain, the subscribing member may be a mall. A central registration station would provided, for example, at the entrance to the mall. Alert stations then would located in each of the individual stores. The custodian would register the child or impaired adult at the registration station. Then, if the registered person became lost in the mall, the custodian would simply locate the nearest alert station, insert his or her card, and an alert would be issued at all of the alert stations throughout the mall.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. A method for establishing a membership of subscribing members for alerting one or more subscribing members to the loss of a registered person within a subscribing member, which comprises the steps of:

(a) establishing a membership of one or more subscribing members;

(b) providing each said subscribing member with access to a registration station having an input for receiving registration information for a person to be registered and an output for issuing a registered person indicator, and an alert station whereat a custodian of said registered person enters said registered person indicator for issuing an alert that said registered person is lost; and (c) creating a database interconnected to each said subscribing member's registration station and alert station via a computer network.

2. The method of claim 1, wherein each said subscribing member comprises one or more of a retail establishment, a neighborhood, or a school.

3. The method of claim 1, wherein said alert comprises one or more of a visual display, an aural broadcast, or an electronic communication.

4. The method of claim 1, wherein said registered person comprises one or more of a child, a mentally impaired person, or a mentally challenged person.

5. The method of claim 1, wherein said computer network comprises a global computer network.

6. The method of claim 1, wherein said registered person indicator comprises an identification card including a magnetic strip and a registered person identifier.

7. A method for alerting persons to the occurrence of a lost registered person within a membership of subscribing member, which comprises the steps of:

(a) establishing a membership of subscribing members;

(b) providing each said subscribing member with access to a registration station having an input for receiving registration information for a person to be registered and an output for issuing a registered person indicator, end an alert station whereat a custodian of said registered person enters said registered person indicator for issuing an alert that said registered person is lost;

(c) creating a database interconnected to each said subscribing member's registration station and alert station via a computer network;

(d) receiving, from a custodian at a said input of a said registration station, registration information for said person to be registered;

(e) issuing a registered person indicator to said custodian at said output station of said registration station;

(f) maintaining said registration information within said database;

(g) receiving said registered person indicator at any said subscribing member's alert station; and (h) issuing an alert in response to receiving said registered person indicator alerting persons to the occurrence of a lost registered person within said membership.

8. The method of claim 7, wherein each said subscribing member comprises one or more of a retail establishment, a neighborhood, or a school.

9. The method of claim 7, wherein said alert comprises one or more of a visual display, an aural broadcast, or an electronic communication.

10. The method of claim 7, wherein said registered person comprises one or more of a child, a mentally impaired person, or a mentally challenged person.

11. The method of claim 7 wherein said step (b) further comprises providing said registration station and alert station as kiosks.

12. The method of claim 7, wherein said step (a) further comprises interconnecting said database to each said subscribing member's registration station and alert station via a global computer network.

13. The method of claim 7, wherein said registered person indicator comprises an identification card including a magnetic strip and a registered person identifier.

* * * * *